US008378571B2

(12) United States Patent
Johnston et al.

(10) Patent No.: US 8,378,571 B2
(45) Date of Patent: Feb. 19, 2013

(54) PRECISION MERCURY DISPENSER USING WIRE

(75) Inventors: David W. Johnston, Kensington, NH (US); Gregory Zaslavsky, Marblehead, MA (US); William George, Lynn, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 367 days.

(21) Appl. No.: 12/902,144

(22) Filed: Oct. 11, 2010

(65) Prior Publication Data

US 2011/0050085 A1 Mar. 3, 2011

Related U.S. Application Data

(63) Continuation-in-part of application No. 11/983,626, filed on Nov. 9, 2007, now Pat. No. 7,812,533.

(51) Int. Cl.
*H01J 17/26* (2006.01)

(52) U.S. Cl. ..... 313/565; 313/639; 313/490; 313/571

(58) Field of Classification Search ..... 313/565, 313/639, 490, 571
See application file for complete search history.

(56) References Cited

U.S. PATENT DOCUMENTS

| | | | | |
|---|---|---|---|---|
| 5,828,169 | A * | 10/1998 | Myojo et al. | 313/490 |
| 6,172,453 | B1 * | 1/2001 | Hamada et al. | 313/491 |
| 6,650,041 | B1 | 11/2003 | Speer et al. | |
| 6,653,775 | B1 | 11/2003 | Speer et al. | |
| 6,784,609 | B2 | 8/2004 | Speer et al. | |
| 6,891,323 | B2 | 5/2005 | Lima et al. | |
| 6,905,385 | B2 | 6/2005 | Speer et al. | |
| 6,906,460 | B2 | 6/2005 | Busai et al. | |
| 6,913,504 | B2 | 7/2005 | Zaslavsky et al. | |
| 2001/0038264 | A1 | 11/2001 | Brumleve et al. | |
| 2003/0230979 | A1 * | 12/2003 | Busai et al. | 313/565 |
| 2004/0041515 | A1 | 3/2004 | Speer et al. | |
| 2004/0104665 | A1 | 6/2004 | Speer et al. | |

FOREIGN PATENT DOCUMENTS

| | | | |
|---|---|---|---|
| EP | 0 568 317 | A1 | 11/1993 |
| EP | 0 809 276 | A1 | 11/1997 |

* cited by examiner

*Primary Examiner* — Nimeshkumar Patel

*Assistant Examiner* — Christopher Raabe

(74) *Attorney, Agent, or Firm* — Shaun P. Montana; Andrew Martin

(57) ABSTRACT

A fluorescent lamp includes a tubular member or envelope having an arc generating and sustaining medium therein. An electrode is provided in each end of the tubular member and a phosphor coating is applied to the interior surface of the tubular member. A mercury dispenser is situated within the tubular member. The mercury dispenser includes a body composed of a material. The body is provided with a bore. A wire plated with a material capable of wetting mercury is provided in the bore. A quantity of mercury is deposited in the bore in contact with the wire.

20 Claims, 7 Drawing Sheets

PRECISION MERCURY DISPENSER USING WIRE

CROSS-REFERENCE TO RELATED APPLICATION(S)

The present application is a continuation-in-part of U.S. patent application Ser. No. 11/983,626, filed Nov. 9, 2007, now U.S. Pat. No. 7,812,533, the entire contents of which are hereby incorporated by reference.

TECHNICAL FIELD

This invention relates to arc discharge lamps and more particularly to fluorescent lamps. Still more particularly, it relates to mercury dispensers for such lamps, methods of dosing mercury into such lamps and methods of making the mercury dispensers.

BACKGROUND

Fluorescent lamps require mercury to operate. Because of mercury's perceived environmental problems, recent regulatory controls impose lower and lower mercury dosing in fluorescent lamps. As these doses decrease, they approach the minimum dose required to operate the lamp over its projected lifetime. It has proven to be very difficult to accurately maintain the very small doses necessary to meet environment constraints while ensuring consistent lamp quality and life.

Fluorescent lamps have been (and still are) dosed with a variety of techniques. Liquid dosing is the simplest and least expensive method; however, it is very inaccurate and virtually impossible at doses lower than 4.5 mg, especially when lamps are processed on high-speed equipment.

In attempts to solve the dosing or dispensing of mercury, industry has used a variety of glass and metal capsules. These techniques offer several advantages, for example, the accuracy and size of the dose is only limited by the mercury metering and delivery equipment used to place the mercury in the capsule. Since these techniques can be run off-line at a separate facility, slow and accurate filling methods can be employed. However, the disadvantages include the fact that the capsules must be mounted on a structure within the lamp, thus adding to the cost and complexity. Further, the capsule must be opened within the lamp after the lamp has been evacuated and the exhaust tube sealed, adding a processing step and the potential for additional lamp failures.

Additional procedures have used the placement within the lamp of a strip of material containing a titanium/mercury alloy that decomposes at temperatures near 900 degrees C. However, the variation in mercury dose from strip to strip is large enough that dosing at amounts less than 2.5 mg is not practical. Also, like the capsules, the strip must be mounted within the lamp in a predictable manner and be activated by an external radio frequency field.

Recently, it has been proposed (U.S. Pat. Nos. 6,905,385 and 6,913,504) that dosing could be accomplished by coating a steel ball with silver and subsequently applying mercury to the silver coating. While this technique provides relatively accurate control over the amount of mercury, it has been found that if the steel ball remains loose in the lamp, it causes damage to the phosphor coating. Further, after manufacture, it is necessary to keep the mercury/silver coated balls separated since it has been found, through testing, that allowing the balls to come into contact with one another allows for the transfer of mercury between them, thus destroying the necessary accuracy for dosing requirements.

SUMMARY

It is, therefore, an object of the invention to obviate the disadvantages of the prior art.

It is another object of the invention to enhance fluorescent lamps.

Still another object is a method of accurately dosing mercury into fluorescent lamps.

These objects are accomplished, in one aspect of the invention, by a mercury dispenser for fluorescent lamps, the mercury dispenser comprising a body in the form of a bead whose material is selected from the group consisting of glass and ceramic; a bore in the body, a first material coating the bore, the material being capable of wetting mercury; and a quantity of mercury in the bore contacting the first material. In another aspect of the invention a method of dispensing mercury into a fluorescent lamp is provided, the method comprising the steps of providing a body selected from the group consisting of glass and ceramic materials, providing a bore in the body; providing a first material as a coating in the bore, the material being capable of wetting mercury; depositing a quantity of mercury within the bore in contact with the first material; inserting the body into a fluorescent lamp via a lamp exhaust tubulation; exhausting and sealing the lamp, and processing the lamp to activate same. In yet another aspect of the invention a method of making a mercury dispenser comprises the steps of forming a body of a material selected from the group of glass and ceramic materials; providing a bore in the body; coating the bore with a mercury wetting material and dispensing a quantity of mercury into the bore. And in still another aspect of the invention a fluorescent lamp is provided, the lamp comprising a tubular member having an arc generating and sustaining medium therein; an electrode at each end of the tubular member; a phosphor coating on the interior of the tubular member, and a body formed of a material selected from the group of glass and ceramic contained with the tubular member, the body having a bore therein, the bore being coated with a mercury wetting material and a quantity of mercury within the bore in contact with the mercury wetting material.

The low mass of the glass or ceramic body does not adversely affect the phosphor coating and the bodies can be shipped in contact with one another without affecting the quantity of mercury. The mercury dosage can be very accurately controlled and the mercury can be loaded into the bodies easily.

DETAILED DESCRIPTION

For a better understanding of the present invention, together with other and further objects, advantages and capabilities thereof, reference is made to the following disclosure and appended claims taken in conjunction with the above-described drawings.

Figure 1:
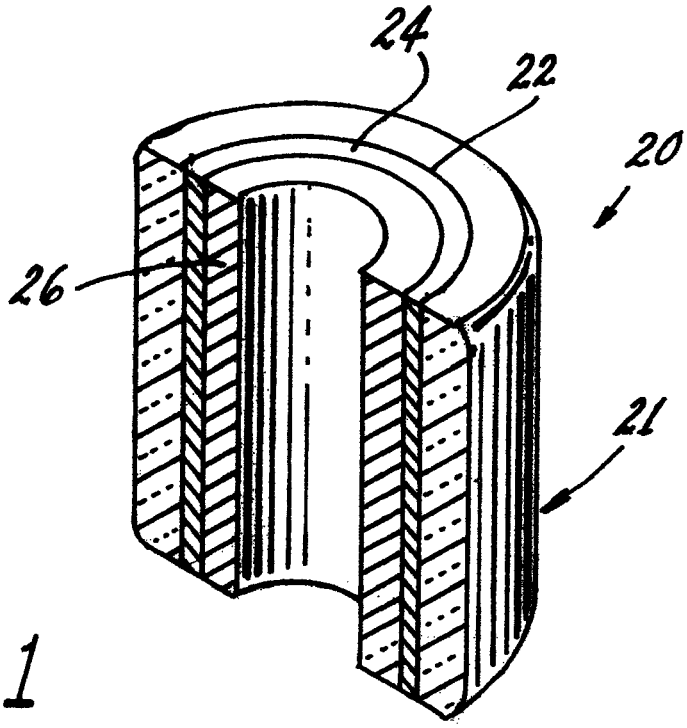
FIG. 1 is a sectional view of an embodiment of the invention.
Figure 2:
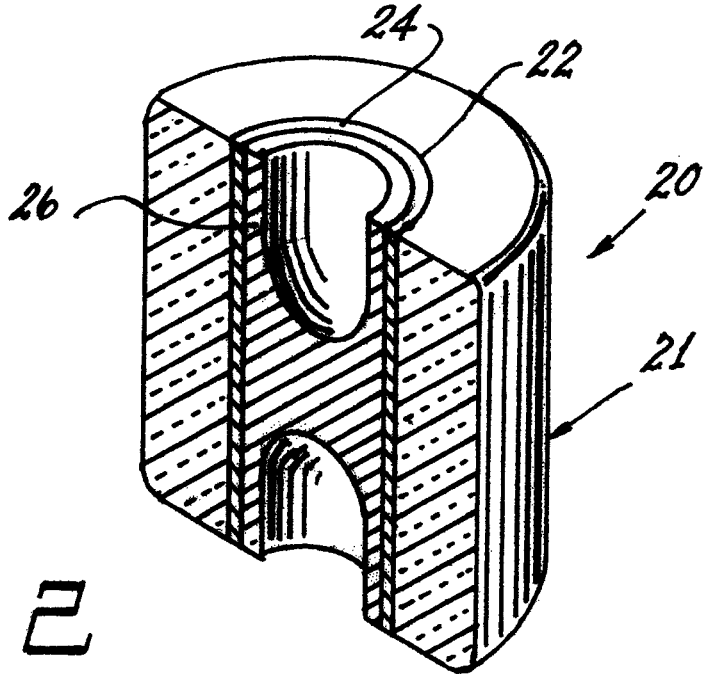
FIG. 2 is a sectional view of another embodiment of the invention.
Figure 3:
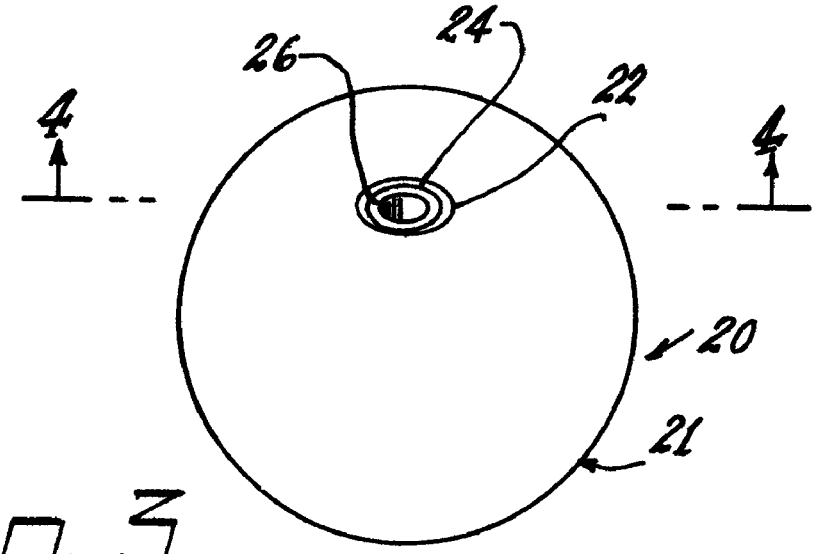
FIG. 3 is a perspective view of an embodiment of the invention.
Figure 4:
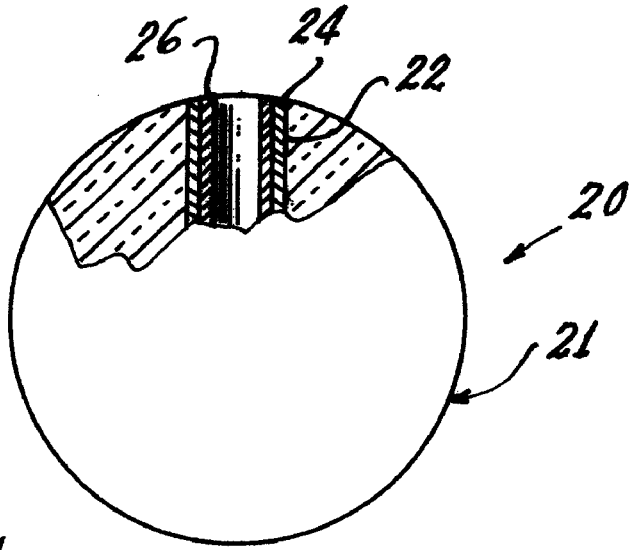
FIG. 4 is a partial sectional view taken along the line 4-4 of FIG. 3.

Referring now to the drawings with greater particularity, there is shown in FIG. 1 a mercury dispenser 20 for an arc discharge lamp, such as fluorescent lamp 10. The mercury dispenser 20 comprises a body 21 composed of a material selected from the group consisting of glass and ceramic materials. A suitable glass can be lime glass, lead glass or a borosilicate glass; however, a lime glass in preferred as that is the material used for the tubular glass envelope. A suitable ceramic is steatite or a similar material. The body 21 can be substantially cylindrical, as shown in FIGS. 1 and 2, or spherical, as shown in FIGS. 3 and 4. Preferably, the body 21, if cylindrical, has a length of 1.6 mm with a diameter of 1.1 mm and if spherical, a diameter of 1.6 mm. The body 21 is provided with a bore 22 having a diameter of 0.7 mm. A first material 24 capable of wetting mercury coats the bore 22. In a preferred embodiment, the first material is silver having a thickness between 0.1μ and 8μ; however, other materials capable of wetting mercury, such as those selected from the group of gold, tin, lead, bismuth, zinc, copper, antimony, iron and alloys thereof can also be employed. A quantity of mercury 26 is deposited in the bore 22 in contact with the first material 24. While the amount of mercury will be dependent upon the size of the body 21 and bore 22, as well as the amount necessary for lamp operation, such as amounts between 0.5 and 3.5 mg, inclusive; however, other amounts can be utilized as shown by TABLE I, below.

TABLE I

| Body | Ag Layer cm | Inner Dia. cm | Length Cm | Weight Ag mg | Max. Hg dose mg |
|---|---|---|---|---|---|
| Type 1 | $1 \times 10^{-5}$ | 0.07 | 0.106 | 0.0034 | 4.2 |
| Type 2 | $1 \times 10^{-5}$ | 0.09 | 0.14 | 0.0074 | 9.3 |
| Type 3 | $1 \times 10^{-5}$ | 0.07 | 0.13 | 0.0035 | 4.3 |
| Type 4 | $1 \times 10^{-5}$ | 0.06 | 0.15 | 0.0034 | 4.2 |

In TABLE I the maximum mercury dose per dispenser 20 is based on a 50° C. solubility of silver in mercury.

Figure 5:
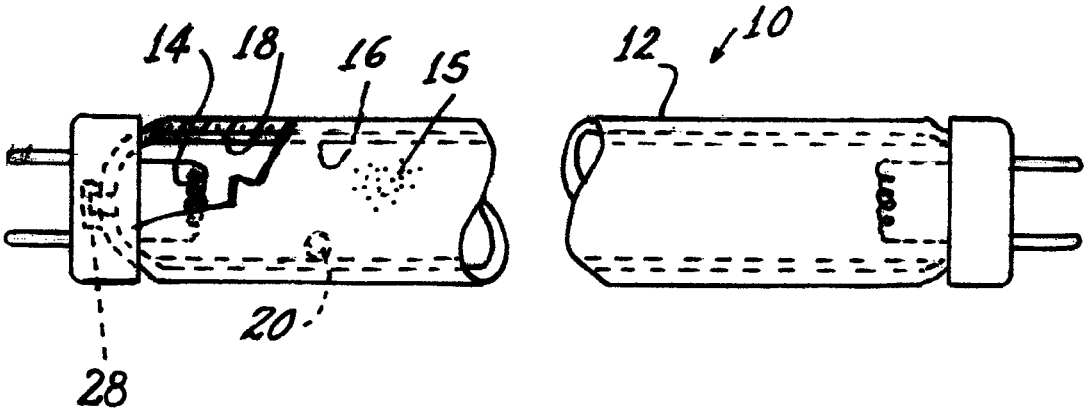
FIG. 5 is an elevation view, partially in section, of a fluorescent lamp in accordance with an embodiment of the invention.

A fluorescent lamp 10, according to an embodiment of the invention and as shown in FIG. 5, comprises a tubular member or envelope 12 having an arc generating and sustaining medium 15 therein. As known, the tubular member 12 is constructed of a suitable glass, for example, lime glass. An electrode 14 is provided at each end of the tubular member 12 and a phosphor coating 16 is applied to the inner surface 18 of the tubular member 12. A mercury dispenser 20 is situated within the tubular member 12.

Ideally, the mercury dispenser 20 is inserted into the tubular member 12 via the exhaust tubulation 28 and the lamp 10 is then processed normally. Tests have shown that the inserted dispenser 20, unlike those comprised of steel bearings, has no deleterious effects on the phosphor coating 16, even during normal packaging and shipping, primarily due to the much lower mass of the glass body when compared to the steel bodies. Tests of prior art silver coated steel balls with a diameter of 2.5 mm and a layer of mercury at 4.0 mg, had a mass of 64 mg, and lamps in which they were used showed significant removal of phosphor one of the lamp ends after normal shipping and handling. In contrast, the glass mercury dispensers 20 of the instant invention had an average mass of 5 mg without the insertion of mercury, which could add up to 5 mg of additional material.

Several methods of dosing the mercury into the dispensers 20 are available, but the preferred approach is to employ a precision ceramic pump designed for dosing micro quantities of liquid, often used in the medical supply field. One such device is known by the name IVEK and is commercially available. When the latter is utilized, the requisite amount of mercury is placed upon a flat plate and the bore of the body or bead 21 is placed over the mercury drop. The mercury is pulled into the bore 22, leaving no residue behind. Alternatively, a needle from such a micro-dosing pump can be inserted into the bore of the bead and the mercury dispensed thereinto.

Glass beads 21 of the type described herein are commercially available as children's toys, used for the purpose of stringing them together for making necklaces and/or bracelets or the like. When these beads arrive from the manufacture it is often found that the silver lining is covered with an acrylic material and it is necessary to remove this acrylic material before dosing with mercury. One method used to remove the acrylic material was submerging and agitating the beads in acetone for a time sufficient to remove the acrylic coating. Another method involves heating the beads in flowing hydrogen at 475° C. for one hour.

These glass beads or bodies 21 can be used to deliver various doses of mercury into fluorescent lamps. For example, the solubility of silver in mercury at 50° C. is 0.08% by weight. Employing a safety factor of two, the maximum dose of mercury, for a bead with 0.0074 mg of silver, with respect to the solubility of silver, is 4.6 mg. However, the other limit on dose size is related to the adhesion between the mercury and the silver layer and the forces the beads will experience between mercury dosing and dispensing into the lamp. This limit is determined by dosing and dispensing processes and equipment used. The minimum amount of mercury that can be dosed with this bead would be 0.017 mg greater than the amount of mercury needed to run the lamp to the end of its rated life. This is based on the silver weighing 0.0074 mg and the requirement that the ratio of mercury to silver remain above 7:3 for the entire life of the lamp. Thus, the practical limit to dosing with this bead is related to the precision with which the mercury can be delivered to the bore of the bead.

Another important aspect of this type of construction is the ability of the mercury to remain within the bore. This can also be a function of the roughness of the silver layer (which, of course, can be based on the roughness of the bore surface). It has been found that an average surface roughness of 1.2μ is acceptable; however, an average surface roughness of 3μ is preferred.

In a subsequent test that included the manufacture of the beads themselves, a 300 mm long borosilicate tube having an outer diameter of 2 mm with a bore of 1.3 mm was coated on the bore with a commercially available silver paste. The paste comprised a silver powder and 5% lead glass frit with terpineol and ethyl cellulose as binders. This paste was thinned with ethylene glycol monopropyl ether in a ratio of 3:1 to lower its viscosity. The coating was dried at 60° C. until flow was undetectable and then at 100° C. for 12 hours to remove the terpineol. The tubing was then fired in a kiln at 525° C., resulting in an approximate weight gain of 0.05 mg/mm of tubing length. The beads were formed by sectioning the tubing with a diamond blade on a dicing saw to 2 mm in length and cleaned with several acetone rinses. Chemical analysis of the beads showed an average silver weight of 0.0664 mg/bead. The average surface roughness of these beads was 1.2μ. The beads were dosed with 2.5 mg of mercury using a metered syringe dosing system. The mercury-containing beads were dispensed into lamps via the exhaust tubulation and the lamps were processed. The beads were free to move within the lamp body and the lamps operated normally. Before insertion into the lamps, the beads were dropped multiple times from a height of 10 cm onto a steel plate. The deceleration of the beads caused no mercury loss from the beads when weighed on a scale accurate to 0.1 μg. The beads were weighed and grouped together for an extended period of time and reweighed. No transfer of mercury occurred from bead to bead despite them being stored in bulk.

The maximum amount of mercury that could be held by the beads described immediately above, with respect to the dissolution of silver in mercury at 50° C., is 41.5 mg using a safety factor of two. Since this volume of mercury exceeds the volume of the bore in the bead, the maximum practical dose is regulated by the retention of the mercury in the bead during the transfer from the dosing process to the dispensing process. The minimum amount of mercury that could be dispensed into a lamp is 0.155 mg above the dose required to take the lamp to the end of life.

While two shapes of bead are specifically disclosed herein (i.e., cylindrical and spherical) it should be noted that the tubing shape is not critical. What is required is a body with a recess that can be coated with a material that wets mercury. In this way, a dose of mercury is held in isolation from other doses, even when the beads are in contact with one another. Glass bead or bodies with silver linings are preferred because they are inexpensive, transparent, inert to operation of the lamp, of light weight, commercially available and easy to deliver into the lamp.

In other embodiments, a silver plated metal wire is used as a source of mercury wetting material in a mercury dispenser. The amount of silver in the dispenser is critical. Too little silver and it will dissolve in the mercury, allowing the mercury to escape. Too much silver and the amount of amalgam created will have an influence over the mercury vapor pressure in the lamp as it ages. The wire is, in some embodiments, electroplated, a process that is far more precise in controlling the amount of silver than the silver paint or even the silver chemical deposition process used on frosted glass beads. When a silver plated metal wire is wound into a spring shape, creating coils (or turns), and then placed into a cavity, or wound into the cavity, the spacing between the coils (or turns) of the spring determines the capillary forces that will be applied to a wetted liquid therebetween. By controlling the spacing between the coils (or turns), mercury retention can be improved over the performance measured on silver plated smooth glass beads and silver plated frosted beads. This allows for greater doses of mercury and/or more severe physical shock without loss of mercury to the surrounding environment.

Figure 6A:
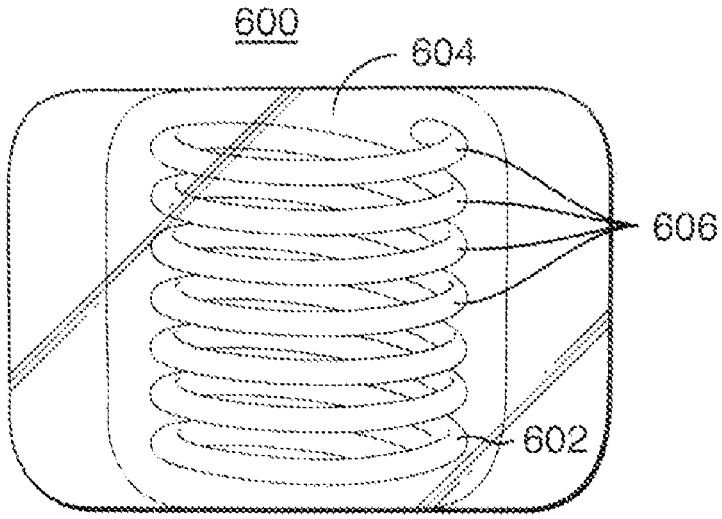
FIGS. 6A and 6B are side views of another embodiment of the invention.
Figure 6B:
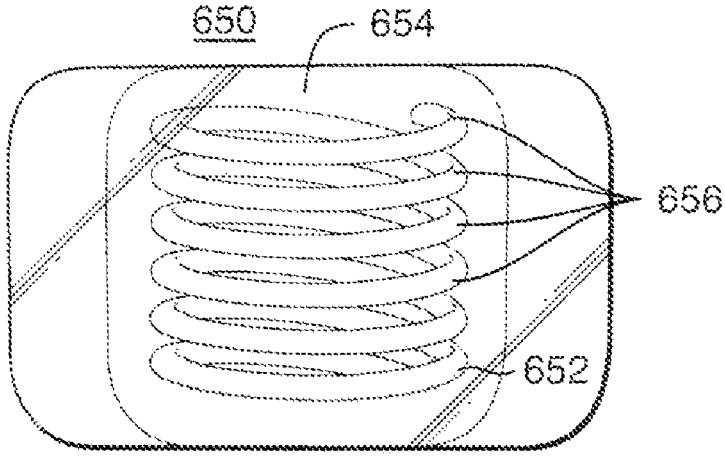

FIG. 6A shows a mercury dispenser 600 made from a Miyuki DBM0141 10/0 clear glass bead with a 0.005 inch silver plated 52 Alloy wire (ASTM F30) coil (or spring) 602 inserted into a bore 604. There are approximately seven turns 606 to the coil 602 and the spacing between the turns 606 is approximately 0.004 inches. FIG. 6B shows a mercury dispenser 650 made from a Miyuki DBM0041 10/0 frosted glass bead with a 0.005 inch silver plated 52 Alloy wire coil (or spring) 652 inserted into a bore 654. The mercury dispenser 652 has been dosed with 2.0 mg mercury. There are six turns 656 to the coil 652 and the spacing between the turns 656 is approximately 0.006 inches.

Figure 7:
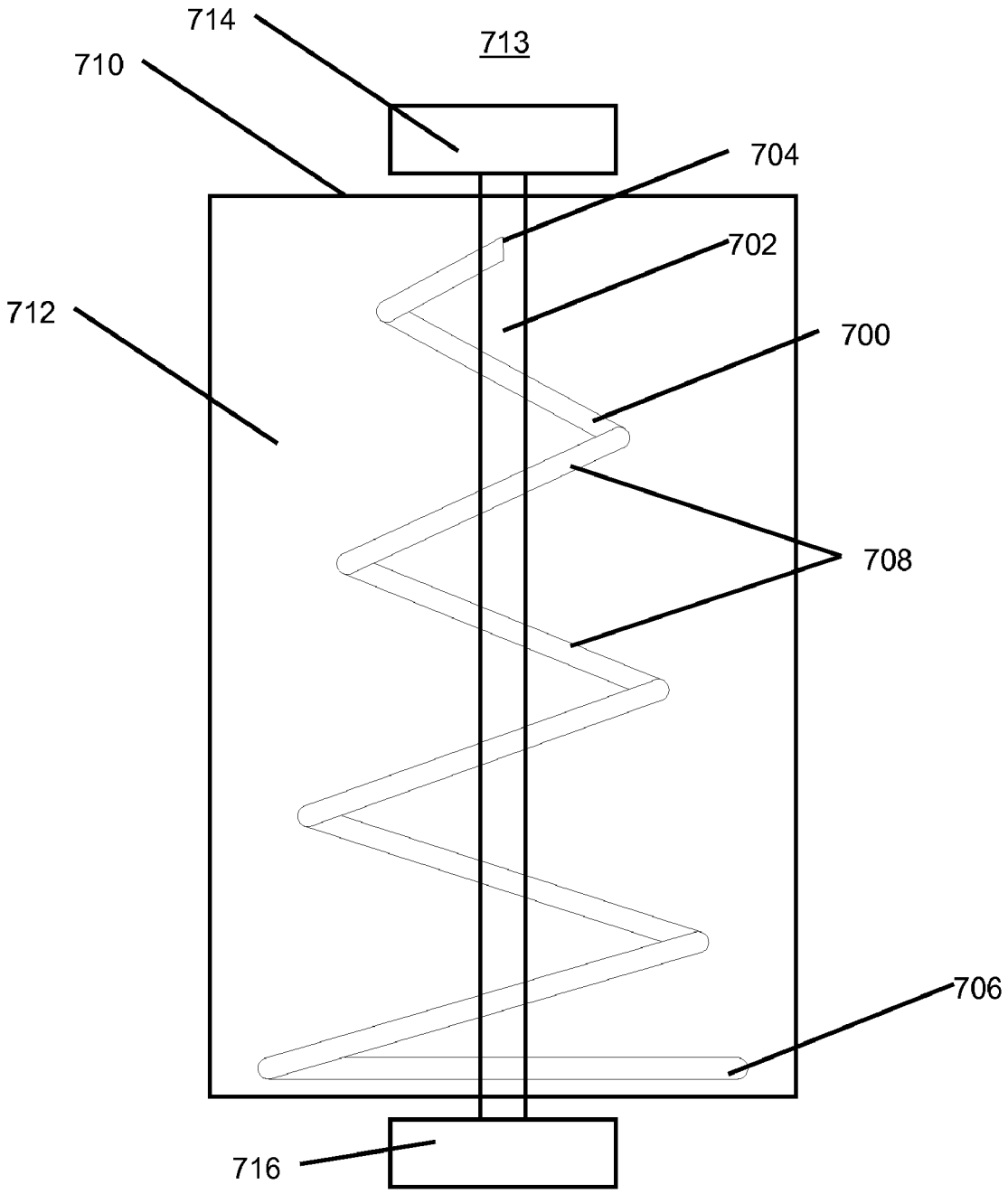
FIG. 7 shows the formation of a wire into a spring, according to embodiments of the invention.

FIG. 7 shows how the springs 602, 652 shown in FIGS. 6A-6B may be formed. In some embodiments, a wire 700 that forms either of the springs 602, 652 is annealed 52 Alloy wire with a diameter of 0.005 inches that is flashed with nickel and then electroplated with 0.0000017 inches of silver. The wire 700 is wound onto a hardened mandril 702 (which is also commonly spelled as "mandrel"), or an equivalent shaped bar capable of winding wire, which in some embodiments has a diameter of 0.031 inches and is made of hardened steel, at a pitch of 0.015 inches. One or both ends 704, 706 of the wire 700 are trimmed, if needed, to form an appropriate number of turns. The diameter of the resulting spring or coil is slightly less than the diameter of a bore it is to be placed in. The spacing between each set of turns 708 (or coils) is greater than a desired coil pitch, which may be but is not limited to 0.011" per turn 708. The mandril 702 and the resultant spring-shaped wire 700 (or coil) may then be threaded, or otherwise entered into, a bore 710 in a body 712 of a mercury dispenser 713. The body may be, but is not limited to, a glass or ceramic bead. In some embodiments, Miyuki DBM0041 frosted 1% beads are used. In such embodiments, the surface roughness of the frosted beads assists in holding the resultant spring (or coil) in the bead. In other embodiments, non-frosted beads are used instead. In some embodiments, the bead may have an outer diameter of 2.1 mm, an inner diameter of 1.1 mm, and a length of 1.75 mm. When the spring 700 (or coil) is centered in the body 712, first and second bushings 714, 716 (or any device that is capable of providing compression to the wire 700) are compressed from each end 704, 706 of the spring 700, increasing its diameter and decreasing its length. In some embodiments, the first bushing 714 may be placed near, or otherwise in the vicinity of, a first end 704 of the spring 700, or the portion of the body 712 containing the first end 704 of the spring 700. The second bushing 716 is then placed on the opposite (second) end 706 of the spring 700, and pressure applied to compress the spring 700 as described above, to, for example, a desired coil pitch, coil spacing, coil diameter, or combinations thereof. The spring 700 is now free from the mandril 702 and is secured inside of the bore 710 of the body 712 of the mercury dispenser 713. After the mercury dispenser 713 is cleaned, the mercury dispenser 713 is ready to receive a dosage of mercury, and in some embodiments, is provided with a dosage of mercury. Thus is achieved, in some embodiments, through use of a Lee Microjet nanoliter dosing valve, which places a small (0.50 mg to 2.00 mg) droplet of mercury into the mercury dispenser. The wetting action of the silver plated spring 700 draws the mercury into the turns 708 of the spring 700 and evenly distributes the mercury.

A method of testing mercury retention was developed to evaluate mercury dispensers used to transport mercury into arc discharge lamps. For each design of a mercury dispenser, a series of mercury doses from 0.5 mg to 2.0 mg mercury, in 0.5 mg increments, are evaluated. The dosed mercury dispensers are weighed on a micro balance, sensitive to 1 μg, and dropped from a height of 5 cm and 10 cm onto a steel plate. The test cycle is repeated (weigh, drop) 10 times. Any change in weight is considered lost mercury due to physical shock. Test results for chemically deposited silver on frosted glass showed no losses, on any dose weight, for the 5 cm drop test. At 10 cm there was no loss of mercury for dose weights of 0.5 mg and 1.0 mg, but some loss in mercury was seen after 4 test cycles at a dose weight of 1.5 mg and the mercury dispensers using chemically deposited silver failed to retain all their mercury at dose weights of 2.0 mg. For embodiments of the mercury dispenser using a silver plated wire (wound into a spring or coil shape), there were no losses of mercury at any of the test parameters (5 cm and 10 cm, all dose weights).

Figures 8A, 8B:
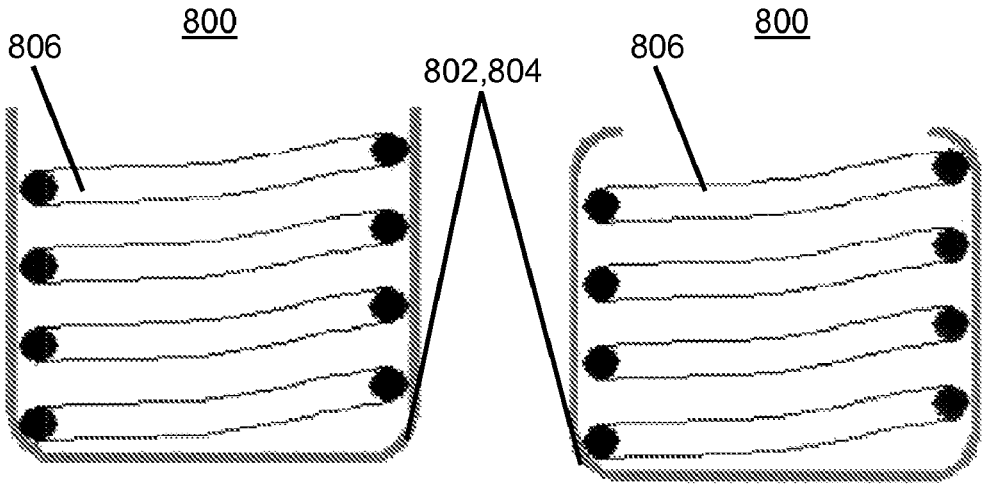
FIGS. 8A-8B show side views of an embodiment of the invention where the body is a metal can.

In some embodiments, such as shown in FIGS. 8A-8B, a mercury dispenser 800 may, instead of using a body 802 that is a bead, use a body 802 that is a metal can 804. The metal can 804 may be, but is not limited to, a 304 stainless steel can, though of course other non-mercury wetting alloys may be used.

Figure 9:
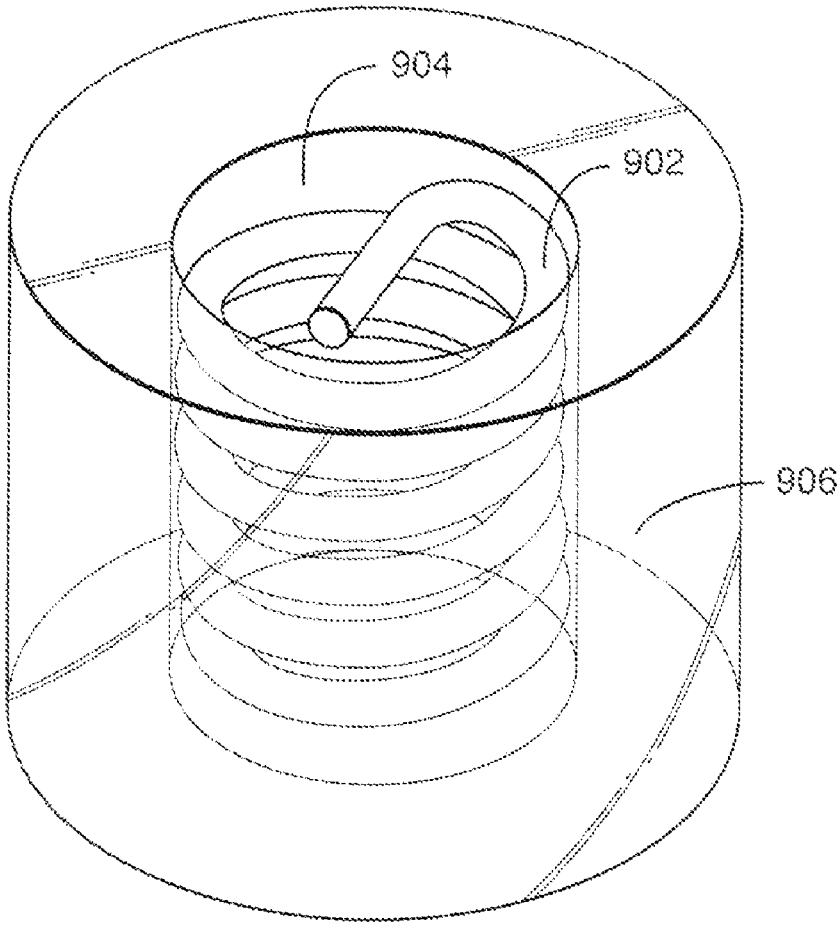
FIG. 9 shows an embodiment of the invention using a heli-coil spring.

In some embodiments, the wire may be steel, or any other non-mercury wetting alloy, that is capable of being coated and/or plated with a mercury-wetting alloy. The wire may have any diameter suitable for holding mercury within the bore of the body of the mercury dispenser until such time is appropriate to dispense the mercury. Finally, in some embodiments, a mercury dispenser 900, as shown in FIG. 9, may use a heli-coil spring 902 that is formed from spring wire that has been plated or coated with a mercury wetting material. The heli-coil spring 902 is made larger than a bore 904 of a body 906 of the mercury dispenser 900, and is threaded into the bore 906, compressing the spring 902 slightly. The spring tension aids in holding the heli-coil spring 902 in place.

While there have been shown and described what are at present considered to be the preferred embodiments of the invention, it will be apparent to those skilled in the art that various changes and modifications can be made herein without departing from the scope of the invention as defined by the appended claims. For example, the wire, whether shaped into a spring (or coil) or not, as described in connection with some embodiments, may exhibit all of the advantages and benefits of the chemically coated mercury dispensers described herein that do not use a wire.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A mercury dispenser for an arc discharge lamp, comprising:

a body including a bore, wherein the body has freedom of movement within the arc discharge lamp;

a wire within the bore, wherein the wire is plated with a material capable of wetting mercury; and a quantity of mercury in the bore in contact with the wire.

2. The mercury dispenser of claim 1 wherein the body comprises:

a body including a bore, wherein the body has freedom of movement within the arc discharge lamp, and wherein the body is made of a glass material or a ceramic material.

3. The mercury dispenser of claim 1, wherein the wire is in the shape of a spring.

4. The mercury dispenser of claim 3, wherein the spring-shaped wire has a defined number of turns, a defined pitch, and a defined spacing between turns.

5. The mercury dispenser of claim 4, wherein the defined number of turns, the defined spacing between turns, and the defined pitch are related to each other and to the quantity of mercury in the bore.

6. The mercury dispenser of claim 1, wherein the body includes a first end and a second end, and wherein the bore results in an opening in only the first end of the body.

7. The mercury dispenser of claim 6, wherein the body is a metal can, and wherein the wire is placed within the bore in the metal can.

8. The mercury dispenser of claim 1, wherein the wire is shaped as a heli-coil spring.

9. The mercury dispenser of claim 1 wherein the wire comprises:

a wire within the bore, wherein the wire is plated with a material capable of wetting mercury and capable of maintaining mercury within the bore when the mercury dispenser comes into contact with another mercury dispenser.

10. A method of dispensing mercury into a fluorescent lamp, comprising:

providing a body;

providing a bore in the body;

providing a wire in the bore in the body, wherein the wire is plated with a material capable of wetting mercury;

depositing a quantity of mercury in the bore in contact with the wire;

inserting the body into the fluorescent lamp;

sealing the fluorescent lamp; and processing the fluorescent lamp to activate the fluorescent lamp, wherein upon activation of the fluorescent lamp, the body dispenses mercury.

11. The method of claim 10 wherein inserting comprises inserting the body into the fluorescent lamp such that the body has freedom of movement within the fluorescent lamp.

12. The method of claim 10, wherein providing a wire comprises:

providing a wire in the bore of the body, wherein the wire is plated with a material capable of wetting mercury, and wherein the wire is in the shape of a spring.

13. The method of claim 12, wherein providing a wire comprises:

shaping a wire plated with a material capable of wetting mercury into a spring having a defined number of turns, a defined pitch, and a defined spacing between turns; and providing the spring-shaped wire in the bore of the body.

14. The method of claim 13 wherein shaping comprises:

shaping a wire plated with a material capable of wetting mercury into a spring having a defined number of turns, a defined pitch, and a defined spacing between turns, wherein the defined number of turns, the defined spacing between turns, and the defined pitch are related to each other and to the quantity of mercury deposited in the bore.

15. A method of making a mercury dispenser for a device, comprising:

forming a body of material, wherein the body has freedom of movement within the device;

providing a bore in the body;

plating a wire with a material capable of wetting mercury;

providing the wire within the bore; and dispensing a quantity of mercury into the bore.

16. The method of claim 15 wherein providing the wire within the bore comprises:

shaping the wire into a spring; and providing the spring-shaped wire within the bore.

17. The method of claim 16 wherein shaping the wire into a spring comprises:

winding the wire on a mandril, wherein the mandril has a first end and a second end;

placing a first bushing on the first end of the mandril;

placing the body over the wire such that the second end of the mandril and the wire wound thereon enter the bore;

placing a second bushing on the body, substantially opposite the first bushing;

compressing the first bushing and the second bushing to shape the wire into a spring; and removing the first bushing, the second bushing, and the mandril.

18. The method of claim 16, wherein shaping the wire into a spring comprises:

shaping the wire into a spring with a defined number of turns, a defined pitch, and a defined spacing between turns.

19. The method of claim 18, wherein shaping the wire into a spring comprises:

shaping the wire into a spring with a defined number of turns, a defined pitch, and a defined spacing between turns, wherein the defined number of turns, the defined spacing between turns, and the defined pitch are related to each other and to the quantity of mercury dispensed in the bore.

20. A fluorescent lamp comprising:

a tubular member having an arc generating and sustaining medium therein;

an electrode at each end of the tubular member;

a phosphor coating on the interior of the tubular member; and a body formed of a material, the body contained within the tubular member and having freedom of movement within the tubular member, the body having a bore therein, the bore including a wire plated with a mercury wetting material and a quantity of mercury contained within the bore in contact with the wire.

* * * * *